US009568848B2

(12) United States Patent
Nagasawa et al.

(10) Patent No.: US 9,568,848 B2
(45) Date of Patent: *Feb. 14, 2017

(54) ELECTROSTATIC IMAGE DEVELOPING TONER

(71) Applicant: Konica Minolta, Inc., Tokyo (JP)

(72) Inventors: Hiroshi Nagasawa, Hachioji (JP); Noboru Ueda, Mitaka (JP); Kouji Sugama, Musashino (JP); Anju Hori, Hachioji (JP); Keisuke Asano, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/883,214

(22) Filed: Oct. 14, 2015

(65) Prior Publication Data

US 2016/0109819 A1 Apr. 21, 2016

(30) Foreign Application Priority Data

Oct. 20, 2014 (JP) ..... 2014-213489

(51) Int. Cl.
*G03G 9/08* (2006.01)
*G03G 9/087* (2006.01)

(52) U.S. Cl.
CPC ..... *G03G 9/08755* (2013.01); *G03G 9/0821* (2013.01)

(58) Field of Classification Search
CPC ..... G03G 9/0821; G03G 9/08755
USPC ..... 430/109.4, 111.4
See application file for complete search history.

(56) References Cited

U.S. PATENT DOCUMENTS

2009/0068578 A1 3/2009 Murakami et al.
2010/0297546 A1 11/2010 Zhou et al.

FOREIGN PATENT DOCUMENTS

JP 2007033773 A 2/2007
JP 4729950 B2 4/2011
JP 4742936 B2 5/2011

OTHER PUBLICATIONS

Notification of Reasons for Refusal dated Sep. 20, 2016 from corresponding Japanese Application; Patent Application No. 2014-213489; English translation of Notification of Reasons for Refusal; Total of 6 pages.
Office Action dated Aug. 11, 2016; U.S. Appl. No. 14/883,167.

*Primary Examiner* — Mark A Chapman
(74) *Attorney, Agent, or Firm* — Lucas & Mercanti, LLP

(57) ABSTRACT

An electrostatic image developing toner includes toner particles that contain a binder resin and a coloring agent. The binder resin includes an amorphous resin and a crystalline polyester resin. The toner satisfies Relations (1) and (2). ΔH1 is the amount of heat absorption based on a melting peak of the crystalline polyester resin in a first heating step from room temperature to 150° C. ΔH2 is the amount of heat absorption based on a melting peak of the crystalline polyester resin in a second heating step from 0° C. to 150° C. ΔH(theo.) is a value of fusion enthalpy calculated from a mass ratio of a structural unit derived from a linear aliphatic monomer contained in the binder resin based on a group contribution method.

Relation (1): $0.2 \leq \Delta H1/\Delta H(\text{theo.}) \leq 0.5$

Relation (2): $0.1 \leq \Delta H2/\Delta H(\text{theo.}) \leq 0.3$

13 Claims, No Drawings

ELECTROSTATIC IMAGE DEVELOPING TONER

CROSS REFERENCE TO RELATED APPLICATION

This Application claims the priority of Japanese Patent Application No. 2014-213489 filed on Oct. 20, 2014, which is incorporated by reference herein.

BACKGROUND OF THE INVENTION

1. Field of the Invention

The present invention relates to an electrostatic image developing toner used for electrophotographic image forming.

2. Description of Related Art

It has been required that electrostatic image developing toners used for electrophotographic image forming (hereinafter also simply referred to as "toners") can be fixed with decreased heat energy in order to increase the printing speed and to reduce the energy consumption of image forming apparatuses. For this reason, further improved low-temperature fixability has been required for toners. For example, in one of such toners known in the art, a crystalline polyester resin having a sharp-melting property is introduced to the toner as a binding resin so as to decrease the glass transition point or the melt viscosity of the binder resin.

Specifically, for example, it is known to use a binder resin that is a mixture of an amorphous resin and a crystalline polyester resin having high miscibility with the amorphous resin. Such combined use of a crystalline polyester resin can improve the low-temperature fixability since the crystalline polyester resin serves as a plasticizer in heat fixing.

Further, another toner known in the art contains crystalline polyester resin in the toner particles as a crystal domain. The low-temperature fixability is obtained by applying heat energy that raises the temperature to a value higher than the melting point of the crystalline polyester resin in heat fixing and thereby melting and dissolving the crystal domain with an amorphous resin (e.g. see JP 4729950B and JP 4742936B).

However, problems with such toners are low heat-resistant storage stability of the toners and low image storage stability of a fixed image obtained by heat fixing, which are due to plasticization caused by mutual dissolution between the amorphous resin and the crystalline polyester resin.

Further, another problem is that when the amorphous resin and the crystalline polyester resin do not exhibit sufficient affinity to each other, the toner particles are more crushable, for example, by stirring in a developing unit.

SUMMARY OF THE INVENTION

The present invention was made in view of the above-described circumstances, and an object thereof is to provide an electrostatic image developing toner that has long lasting crush resistance as well as adequate low-temperature fixability and adequate heat-resistant storage stability and that also can form a fixed image having good image storage stability.

In order to realize the above object, according to a first aspect of the present invention, there is provided an electrostatic image developing toner including toner particles that contain a binder resin and a coloring agent, wherein the binder resin includes an amorphous resin and a crystalline polyester resin, and wherein the electrostatic image developing toner satisfies both of the following Relation (1) and Relation (2), $$0.2 \leq \Delta H1/\Delta H(\text{theo.}) \leq 0.5 \quad \text{Relation (1):}$$

$$0.1 \leq \Delta H2/\Delta H(\text{theo.}) \leq 0.3 \quad \text{Relation (2):}$$

where ΔH1 (J/g) is the amount of heat absorption based on a melting peak of the crystalline polyester resin in a first heating step from room temperature to 150° C., determined on a DSC curve of the electrostatic image developing toner measured by a differential scanning calorimetry, ΔH2 (J/g) is the amount of heat absorption based on a melting peak of the crystalline polyester resin in a second heating step from 0° C. to 150° C., determined on the DSC curve of the toner, and ΔH(theo.) is a value of fusion enthalpy calculated from a mass ratio of a structural unit derived from a linear aliphatic monomer contained in the binder resin based on a group contribution method.

Preferably, the crystalline polyester resin has a melting point of 65° C. to 85° C.

Preferably, in Relation (2), the electrostatic image developing toner satisfies 0.12≤ΔH2/ΔH(theo.)≤0.28.

Preferably, in Relation (2), the electrostatic image developing toner satisfies 0.15≤ΔH2/ΔH(theo.)≤0.28.

Preferably, in Relation (2), the electrostatic image developing toner satisfies 0.16≤ΔH2/ΔH(theo.)≤0.20.

Preferably, ΔH2 is from 2 J/g to 10 J/g.

Preferably, in Relation (1), the electrostatic image developing toner satisfies 0.3≤ΔH1/ΔH(theo.)≤0.5.

Preferably, in Relation (1), the electrostatic image developing toner satisfies 0.32≤ΔH1/ΔH(theo.)≤0.45.

Preferably, in Relation (1), the electrostatic image developing toner satisfies 0.35≤ΔH1/ΔH(theo.)≤0.43.

Preferably, ΔH1 is from 3 J/g to 30 J/g.

Preferably, a content of the crystalline polyester resin in the binder resin is from 5 mass % to 50 mass %.

Preferably, a content of the crystalline polyester resin is from 10 mass % to 20 mass %.

Preferably, the electrostatic image developing toner satisfies the following Relation (3).

$$\Delta H2 < \leq \Delta H1 \quad \text{Relation (3):}$$

DETAILED DESCRIPTION OF THE PREFERRED EMBODIMENT

Hereinafter, the present invention will be described specifically. Though various technical limitations which are preferable to perform the present invention are included in the after-mentioned embodiment, the scope of the invention is not limited to the following embodiment and the illustrated examples.

The toner of the present invention includes toner particles that include coloring particles containing a binder resin and a coloring agent. The binder resin includes an amorphous resin and a crystalline polyester resin.

Further, the electrostatic image developing toner is featured by satisfying both of the following Relation (1) and Relation (2), where ΔH1 (J/g) is the amount of heat absorption based on a melting peak of the crystalline polyester resin in the first heating step from room temperature to 150° C., determined on a DSC curve of the electrostatic image developing toner measured by differential scanning calorimetry, ΔH2 (J/g) is the amount of heat absorption based on a melting peak of the crystalline polyester resin in the second heating step from 0° C. to 150° C., determined on the DSC curve, and ΔH(theo.) is the value of fusion enthalpy calculated from a mass ratio of a structural unit derived from a linear aliphatic monomer contained in the binder resin (hereinafter referred to as a binder resin linear aliphatic monomer) based on a group contribution method.

$$0.2 \leq \Delta H1/\Delta H(\text{theo.}) \leq 0.5 \quad \text{Relation (1):}$$

$$0.1 \leq \Delta H2/\Delta H(\text{theo.}) \leq 0.3 \quad \text{Relation (2):}$$

The value of ΔH1/ΔH(theo.) of Relation (1) is more preferably 0.3≤ΔH1/ΔH(theo.)≤0.5, yet more preferably 0.32≤ΔH1/ΔH(theo.)≤0.45, particularly preferably 0.35≤ΔH1/ΔH(theo.)≤0.43.

The value of ΔH2/ΔH(theo.) of Relation (2) is more preferably 0.12≤ΔH2/ΔH(theo.)≤0.28, yet more preferably 0.15≤ΔH2/ΔH(theo.)≤0.28, particularly preferably 0.16≤ΔH2/ΔH(theo.)≤0.20.

The differential scanning calorimetry of the toner is conducted by using a "Diamond DSC" (PerkinElmer Inc.) in the measuring condition (heating and cooling conditions) in which a sample undergoes the first heating step of raising the temperature from room temperature to 150° C. at a heating rate of 10° C./min and holding the temperature at 150° C. for 5 minutes, a cooling step of decreasing the temperature from 150° C. to 0° C. at a cooling rate of 10° C./min and holding the temperature at 0° C. for 5 minutes, and the second heating step of raising the temperature from 0° C. to 150° C. at a heating rate of 10° C./min in the written order. Regarding the measuring process, 3.0 mg of the toner is sealed in an aluminum pan and is placed in a sample holder of the "Diamond DSC". An empty aluminum pan is used for a reference.

In the above-described DSC curve measured by differential scanning calorimetry, when the melting peak of ΔH1 overlaps with a peak of another toner component, such as a releasing agent, and appears as an overlapped peak having two or more peak tops, the amount of heat absorption ΔH (J/g) from the start to the end of the overlapped peak with respect to the base line is determined. Further, the fractional area ratio S1 (%) of the melting peak derived from the crystalline polyester resin with respect to the peak area of the overlapped peak is also determined. Then, ΔH1 (J/g) is calculated as ΔH (J/g)×S1 (%). The fractional area ratio S1 of the melting peak derived from the crystalline polyester resin in the overlapped peak is determined by dividing the peak area by a perpendicular from a minimum point between the peak tops to the temperature axis, determining a peak having a peak top temperature closest to the melting point of the pure crystalline polyester resin among the peak tops of the overlapped peak as the melting peak derived from the crystalline polyester resin, and calculating the fractional area ratio thereof.

The same applies to ΔH2 when its melting peak has two or more peak tops.

Specifically, ΔH(theo.) is calculated by using parameters of the group contribution method described in "Properties of Polymers: Their Correlation with Chemical Structure; Their Numerical Estimation and Prediction from Additive Group Contributions" (by D. W. van Krevelen and Klaas to Nijenhuis, ISBN: 9780080548197).

As used herein, a binder resin linear aliphatic monomer refers to a linear aliphatic polycarboxylic acid, a linear aliphatic polyhydric alcohol and a linear aliphatic hydroxycarboxylic acid. When such compounds are not used for producing the amorphous resin of the binder resin, the binder resin linear aliphatic monomer of the toner of the present invention designates only the linear aliphatic polycarboxylic acid, linear aliphatic polyhydric alcohol and linear aliphatic hydroxycarboxylic acid for producing the crystalline polyester resin. When such compounds are used for producing the amorphous resin of the binder resin (e.g. when the amorphous resin is an amorphous polyester resin), the binder resin linear aliphatic monomer of the toner designates the linear aliphatic polycarboxylic acid, linear aliphatic polyhydric alcohol and linear aliphatic hydroxycarboxylic acid for producing the amorphous polyester resin as well as the linear aliphatic polycarboxylic acid, linear aliphatic polyhydric alcohol and linear aliphatic hydroxycarboxylic acid for producing the crystalline polyester resin.

The mass ratio of the structural unit derived from the binder resin linear aliphatic monomer is measured by a $^1$H-NMR measurement for a degraded monomer solution in which the binder resin is hydrolyzed by a degrading liquid composed of a deuterated solvent and sodium hydroxide dissolved therein.

The deuterated solvent used in the degrading liquid is a pure solvent or a mixed solvent containing water or an alcohol and may be any solvent that can dissolve the binder resin linear aliphatic monomer in the degraded monomer solution produced by the degradation. However, it is preferred to select a solvent according to the polarity of the binder resin and the binder resin linear aliphatic monomer. In terms of the reactivity, it is preferred to use a solvent that can dissolve the binder resin.

Whether the binder resin is sufficiently hydrolyzed can be checked by an analysis of the residue by pyrolysis GC-MS or the like. Signal assignment in the $^1$H-NMR measurement can be made by using monomer standards qualitatively analyzed by pyrolysis GC-MS or by a variety of two-dimensional NMR spectroscopies known in the art.

The mole number of ester groups used for calculating ΔH(theo.) is the smaller number between the total number of carboxylic residues or the total number of alcohol residues in the structural unit derived from the binder resin linear aliphatic monomer.

ΔH1/ΔH(theo.) represents the ratio of crystalline polyester resin that is present as a crystal domain in the toner particles with respect to the total crystalline polyester resin in the toner particles. When ΔH1/ΔH(theo.) is within the range of 0.2 to 0.5, adequate heat-resistant storage stability is achieved by the presence of the crystal domain with high melting point and high hardness in the toner particles when the toner is stored at a temperature less than the melting point of the crystalline polyester resin. Further, since the crystalline polyester resin and the amorphous resin exhibit high affinity to each other, the toner particles can be prevented from being crushed by stirring in a developing unit or the like.

ΔH2/ΔH(theo.) represents the ratio of the crystalline polyester resin being a crystal domain in an fixed image after heat fixing. When ΔH2/ΔH(theo.) is within the range of 0.1 to 0.3, the crystal domain composed of the crystalline polyester resin is fused in heat fixing so that not only the crystalline polyester resin itself is softened but also it is plasticized by mutual dissolution with the surrounding other binder resin. Therefore, heat fixing can be performed at a lower temperature. Further, the crystalline polyester resin is partly recrystallized to form a crystal domain in a fixed image after heat fixing. Since the crystal domain has a high melting point and a high hardness, the fixed image has good image storage stability.

It is preferred that the toner of the present invention further satisfies the following Relation (3).

$$\Delta H2 < \leq \Delta H1 \quad \text{Relation (3):}$$

When the toner of the present invention satisfies Relation (3), i.e. when the amount of crystal domain after heat fixing is less than the amount of crystal domain before heat fixing, it means mutual dissolution between the crystalline polyester resin and the amorphous resin progresses certainly in heat fixing. Therefore, very good low-temperature fixability is achieved.

The value of ΔH1 is preferably from 3 J/g to 30 J/g, and the value of ΔH2 is preferably from 2 J/g to 10 J/g.

The value of ΔH1/ΔH(theo.) can be controlled by changing the composition of the polycarboxylic acid, polyhydric alcohol and hydroxycarboxylic acid for producing the crystalline polyester resin, the composition of the amorphous resin, the temperature during the production of the toner and the like.

The value of ΔH2/ΔH(theo.) can be controlled by changing the composition of the polycarboxylic acid, polyhydric alcohol and hydroxycarboxylic acid for producing the crystalline polyester resin, the composition of the amorphous resin and the like.

Binder Resin

The binder resin of the toner particles according to the present invention includes the amorphous resin and the crystalline polyester resin.

The crystalline polyester resin may also be a styrene acrylate-modified polyester resin in which a styrene acrylate polymer segment and a crystalline polyester polymer segment are bound together.

Crystalline Polyester Resin

A crystalline polyester resin refers to a polyester resin that does not exhibit a stepwise change in the amount of heat absorption but a clear melting peak in differential scanning calorimetry (DSC) among polyester resins known in the art that are produced by a polycondensation reaction of a di- or more carboxylic acid (polycarboxylic acid) and a hydroxycarboxylic acid and a di- or more hydric alcohol (polyhydric alcohol). Specifically, a clear melting peak means a melting peak with a half width of 15° C. or less in the second heating step in the DSC curve of the pure crystalline polyester resin measured by the above-described differential scanning calorimetry.

Melting Point of Crystalline Polyester Resin

The melting point of the crystalline polyester resin is preferably from 65° C. to 85° C., more preferably from 75° C. to 85° C.

When the crystalline polyester resin has a melting point within the above-described range, adequate low-temperature fixability and good image storage stability can be achieved.

The melting point of the crystalline polyester resin can be adjusted by changing the resin composition.

The melting point of the crystalline polyester resin corresponds to the peak top temperature of the melting peak in the second heating step in the DSC curve of the pure crystalline polyester resin measured by the above-described differential scanning calorimetry. When there are a plurality of melting peaks in the DSC curve, the peak top temperature of a melting peak having the largest amount of heat absorption is determined as the melting point.

The polycarboxylic acid for producing the crystalline polyester resin is a compound having two or more carboxyl groups in a molecule.

Specifically, such compounds include, for example, saturated aliphatic dicarboxylic acids such as succinic acid, sebacic acid and dodecanedioic acid; alicyclic dicarboxylic acids such as cyclohexane dicarboxylic acid; aromatic dicarboxylic acids such as phthalic acid, isophthalic acid and terephthalic acid; tri- or more carboxylic acids such as trimellitic acid and pyrometllitic acid; anhydrides of these carboxylic acids or esters of these carboxylic acids with an alkyl of 1 to 3 carbons; and the like. An aliphatic dicarboxylic acid is preferably used as the polycarboxylic acid for producing the crystalline polyester resin.

These compounds may be used alone or in combination of two or more.

The polyhydric alcohol for producing the crystalline polyester resin is a compound having two or more hydroxyl groups in a molecule.

Specifically, such compounds include, for example, aliphatic diols such as ethylene glycol, 1,2-propanediol, 1,3-propanediol, 1,4-butanediol, 1,5-pentanediol, 1,6-hexanediol, 1,7-heptanediol, 1,8-octanediol, neopentyl glycol and 1,4-butenediol; tri- or more hydric alcohols such as glycerin, pentaerythritol, trimethylol propane and sorbitol. An aliphatic diol is preferably used as the polyhydric alcohol for producing the crystalline polyester resin.

These compounds may be used alone or in combination of two or more.

The linear aliphatic hydroxycarboxylic acid may be used in combination with the polycarboxylic acid and/or the polyhydric alcohol.

Examples of such linear aliphatic hydroxycarboxylic acids for producing the crystalline polyester resin include 5-hydroxypentanoic acid, 6-hydroxyhexanoic acid, 7-hydroxypentanoic acid, 8-hydroxyoctanoic acid, 9-hydroxynonanoic acid, 10-hydroxydecanoic acid, 12-hydroxydodecanoic acid, 14-hydroxytetradecanoic acid, 16-hydroxyhexadecanoic acid, 18-hydroxyoctadecanoic acid, lactones produced by cyclization of these hydroxycarboxylic acids, alkyleters of these hydroxycarboxylic acids with an alcohol of 1 to 3 carbons, and the like.

These compounds may be used alone or in combination of two or more.

The crystalline polyester resin may be produced by any method including a general polymerization method of polyester in which the above-described polycarboxylic acid and polyhydric alcohol are reacted in the presence of a catalyst. For example, it is preferred that a direct polycondensation method or a transesterification method is suitably selected according to the type of the monomers.

Examples of catalysts that can be used for producing the crystalline polyester resin include, for example, titanium catalysts such as titanium tetraethoxide, titanium tetrapropoxide, titanium tetraisopropoxide and titanium tetrabutoxide, tin catalysts such as dibutyltin dichloride, dibutyltin oxide and diphenyltin oxide, and the like.

Regarding the ratio of the polycarboxylic acid and the polyhydric alcohol, it is preferred that the stoichiometric ratio of the hydroxyl groups (OH) of the polyhydric alcohol to the carboxyl groups (COOH) of the polycarboxylic acid is from 1.5/1 to 1/1.5, more preferably from 1.2/1 to 1/1.2.

Acid Value and Hydroxyl Value of Crystalline Polyester Resin

It is preferred that the crystalline polyester resin has an acid value of 5 mgKOH/g to 30 mgKOH/g, more preferably 10 mgKOH/g to 25 mgKOH/g, yet more preferably 15 mgKOH/g to 25 mgKOH/g. Further, the difference between the hydroxyl value and the acid value ((hydroxyl value)−(acid value)) is preferably from 1 mgKOH/g to 25 mgKOH/g, more preferably from 5 mgKOH/g to 15 mgKOH/g. The acid value and the hydroxyl value are measured by ordinary methods.

Molecular Weight of Crystalline Polyester Resin

It is preferred that the crystalline polyester resin has a weight average molecular weight (Mw) of 5000 to 50000 and a number average molecular weight (Mn) of 1500 to 25000, which are calculated from the molecular weight distribution measured by gel permeation chromatography (GPC).

The molecular weight is measured by GPC as follows. A device "HLC-8220" (TOSOH Corp.) and a column set "TSK guard column+3×TSK gel Super HZM-M" (TOSOH Corp.) are used. The column temperature is held at 40° C., and tetrahydrofuran (THF) is supplied at a flow rate of 0.2 ml/min as carrier solvent. The sample (crystalline polyester resin) is dissolved in tetrahydrofuran to a concentration of 1 mg/ml by a treatment with an ultrasonic disperser at room temperature for 5 minutes. The solution is then treated with a membrane filter having a pore size of 0.2 μm to obtain a sample solution. An aliquot (10 μl) of the sample solution is injected into the device along with the carrier solvent and is detected by means of a refractive index (RI) detector. The molecular weight distribution of the sample is calculated by using a calibration curve, which is determined by using standard monodisperse polystyrene particles. Polystyrenes respectively having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$ (Pressure Chemical Company) are used as the standard polystyrene samples used for determining the calibration curve. At least ten different standard polystyrene samples are measured to determine the calibration curve. A refractive index detector is used as the detector.

It is preferred that the content of the crystalline polyester resin in the binder resin is from 5 mass % to 50 mass %, more preferably from 5 mass % to 30 mass %.

When the content of the crystalline polyester resin in the binder resin is equal to or greater than 5 mass %, adequate low-temperature fixability can be certainly achieved. When the content of the crystalline polyester resin in the binder resin is equal to or less than 50 mass %, the crystalline polyester resin can be certainly introduced to the toner particles in the production of the toner.

Amorphous Resin

An amorphous resin refers to a resin that does not exhibit any clear endothermic peak in differential scanning calorimetry (DSC).

The amorphous resin may be a polyester resin, a styrene acrylate resin or the like. It is preferred that a styrene acrylate resin as the amorphous resin has a structural unit derived from an acid monomer such as acrylic acid and methacrylic acid.

When a polyester resin is used as the amorphous resin, the crystallinity of the crystalline polyester resin contained together in the binder resin can be changed by changing the temperature profile in the production of the toner such as the cooling rate and the drying temperature of the toner. The production of the toner is described in detail below. Specifically, it is likely that ΔH1 can be increased by slowing down the cooling rate around the glass transition point of the polyester resin of the amorphous resin in the cooling step or by setting the drying temperature of the drying step to a value around the glass transition point of the polyester resin of the amorphous resin.

It is preferred that the amorphous resin has a number average molecular weight (Mn) of 1500 to 25000 and a weight average molecular weight (Mw) of 10000 to 80000, which are measured by gel permeation chromatography (GPC).

When the molecular weight of the amorphous resin is within the above-described range, both of adequate low-temperature fixability and good heat-resistant storage stability can be achieved more certainly.

The molecular weight of the amorphous resin is measured by GPC in the same manner as above except that the sample is the amorphous resin.

It is preferred that the amorphous resin has a glass transition point of 35° C. to 70° C., more preferably 50° C. to 60° C.

When the glass transition point of the amorphous resin is equal to or greater than 35° C., the toner can have a sufficient thermal strength, and the adequate heat-resistant storage stability can therefore be achieved. When the glass transition point of the amorphous resin is equal to or less than 70° C., the adequate low-temperature fixability can be achieved more certainly.

The glass transition point of the amorphous resin is measured as follows. The above-described differential scanning calorimetry is conducted for the amorphous resin to obtain the DSC curve. The data on the second heating step thereof is analyzed, and the intersection of the extended base line of the curve in the part before the rise of the first endothermic peak with the steepest tangent of the curve in the part from the rise to the peak top of the first peak is determined as the glass transition point.

In the toner of the present invention, it is preferred that the toner particles have a core-shell structure in which the surface of core coloring particles containing the binder resin and the coloring agent are covered with a shell layer.

The shell layer may not completely cover the core particles, but the surface of the core particles may be partly exposed.

By the core-shell structure of the toner particles, good heat-resistant storage stability can be achieved.

The shell layer may be made of any resin, and amorphous polyester resin and vinyl resins are preferred.

Coloring Agent

For the coloring agent, various coloring agents known in the art such as carbon black, black iron oxide, dyes and pigments may be used.

Examples of such carbon black include, for example, channel black, furnace black, acetylene black, thermal black, lamp black and the like. Examples of such black iron oxide include, for example, magnetite, hematite, iron titanium trioxide and the like.

Examples of such dyes include, for example, C. I. Solvent Red 1, C. I. Solvent Red 49, C. I. Solvent Red 52, C. I. Solvent Red 58, C. I. Solvent Red 63, C. I. Solvent Red 111, C. I. Solvent Red 122, C. I. Solvent Yellow 19, C. I. Solvent Yellow 44, C. I. Solvent Yellow 77, C. I. Solvent Yellow 79, C. I. Solvent Yellow 81, C. I. Solvent Yellow 82, C. I. Solvent Yellow 93, C. I. Solvent Yellow 98, C. I. Solvent Yellow 103, C. I. Solvent Yellow 104, C. I. Solvent Yellow 112, C. I. Solvent Yellow 162, C. I. Solvent Blue 25, C. I. Solvent Blue 36, C. I. Solvent Blue 60, C. I. Solvent Blue 70, C. I. Solvent Blue 93, C. I. Solvent Blue 95 and the like.

Examples of such pigments include, for example, C. I. Pigment Red 5, C. I. Pigment Red 48:1, C. I. Pigment Red 48:3, C. I. Pigment Red 53:1, C. I. Pigment Red 57:1, C. I. Pigment Red 81:4, C. I. Pigment Red 122, C. I. Pigment Red 139, C. I. Pigment Red 144, C. I. Pigment Red 149, C. I. Pigment Red 150, C. I. Pigment Red 166, C. I. Pigment Red 177, C. I. Pigment Red 178, C. I. Pigment Red 222, C. I. Pigment Red 238, C. I. Pigment Red 269, C. I. Pigment Orange 31, C. I. Pigment Orange 43, C. I. Pigment Yellow 14, C. I. Pigment Yellow 17, C. I. Pigment Yellow 74, C. I.

Pigment Yellow 93, C. I. Pigment Yellow 94, C. I. Pigment Yellow 138, C. I. Pigment Yellow 155, C. I. Pigment Yellow 156, C. I. Pigment Yellow 158, C. I. Pigment Yellow 180, C. I. Pigment Yellow 185, C. I. Pigment Green 7, C. I. Pigment Blue 15:3, C. I. Pigment Blue 60 and the like.

These coloring agents may be used alone or in combination of two or more for producing the respective color toners.

The content of the coloring agent in the toner particles is preferably from 1 mass % to 10 mass %, more preferably from 2 mass % to 8 mass %.

Components of Toner Particles

The toner particles according to the present invention may contain an internal additive such as a releasing agent and a charge controlling agent according to need in addition to the binder resin and the coloring agent.

Releasing Agent

For the releasing agent, a variety of waxes known in the art may be used.

Waxes that can be suitably used include polyolefin waxes such as low-molecular weight polypropylene, polyethylene, oxidized polypropylene and polyethylene, ester waxes such as behenyl behenate, and the like.

To be more specific, examples of such waxes include, for example, polyolefin waxes such as a polyethylene wax and a polypropylene wax; branched chain hydrocarbon waxes such as a microcrystalline wax; long chain hydrocarbon waxes such as a paraffin wax and SASOLWAX, dialkylketone waxes such as distearylketone, ester waxes such as carnauba wax, montan wax, behenyl behenate, trimethylolpropane tribehenate, pentaerythritol tetrabehenate, pentaerythritol diacetate behenate, glycerin tribehenate, 1, 18-octadecanediol distearate, tristearyl trimellitate and distearyl maleate; amide waxes such as ethylenediamine behenylamide and trimellitic tristearylamide, and the like.

It is preferred that the releasing agent does not cause an interaction such as mutual dissolution with the crystalline polyester resin of the binder resin.

Among the above-described compounds, those having a low melting point, specifically having a melting point of 60° C. to 100° C. are preferably used in terms of the releasing property in low-temperature fixing. Further, it is preferred that the releasing agent has a melting point of approximately (Mp1−10°) C. to (Mp1+20°) C., where Mp1 is the melting point of the crystalline polyester resin of the binder resin.

The content of the releasing agent in the toner particles is preferably from 1 to 20 mass %, more preferably from 5 to 20 mass %. When the content of the releasing agent in the toner particles is within the above-described range, both of releasing property and fixability are achieved more certainly.

To introduce the releasing agent to the toner particles, an example method is to aggregate and fuse the pure releasing agent fine particles along with the amorphous resin fine particles and the crystalline polyester resin fine particles in an aqueous medium in the aggregating and fusing step of the method for producing the toner described below. Fine particles of the releasing agent can be obtained as a dispersion in which the releasing agent is dispersed in an aqueous medium. Such a dispersion of the releasing agent fine particles can be prepared by heating an aqueous medium containing a surfactant at a temperature higher than the melting point of the releasing agent, adding a melted releasing agent solution, applying a mechanical energy such as mechanical stirring or an ultrasonic energy to finely disperse the releasing agent, and thereafter cooling the dispersion.

When the amorphous resin is a styrene acrylate resin or the like, the releasing agent may be introduced to the toner particles by blending the releasing agent with the amorphous resin fine particles (styrene acrylate resin fine particles) before they are subjected to the aggregating and fusing step. Specifically, such an amorphous resin fine particle dispersion containing the releasing agent can be prepared by so-called mini-emulsion polymerization that involves dissolving the releasing agent in a solution of a polymerizable monomer for producing a styrene-acrylate resin, adding the solution to an aqueous medium containing a surfactant, applying a mechanical energy such as mechanical stirring or an ultrasonic energy to finely disperse the solution as described above, and thereafter adding a polymerization initiator to cause polymerization at a desired polymerization temperature.

Charge Controlling Agent

For the charge controlling agent, a variety of compounds known in the art can be used.

The content of the charge controlling agent in the toner particles is preferably from 0.1 to 10 mass %, more preferably from 1 to 5 mass %.

Average Particle Size of Toner

It is preferred that the toner of the present invention has an average particle size of, for example, 3 μm to 8 μm, more preferably 5 μm to 8 μm in volume median size. When the toner is produced by an emulsion aggregation method described below for example, the average particle size can be controlled by changing the concentration of a coagulant used, the amount of organic solvent added, fusing time, polymer composition and the like.

When the volume median particle size is within the above-described range, the transferring efficiency is increased. Therefore, the halftone image quality is improved. Further, the image quality of thin lines and dots is improved.

The volume median particle size of the toner is measured and calculated by using a measuring equipment composed of a "MULTISIZER 3" (Beckman Coulter Inc.) and a computer system installed with a data processing software "Software V3.51" connected thereto. Specifically, 0.02 g of a sample (toner) is added to 20 mL of a surfactant solution (for dispersing the toner particles, e.g. a surfactant solution prepared by eluting a neutral detergent containing a surfactant component with purified water by 10 times) and is allowed to be uniform, and then the solution is subjected to ultrasonic dispersion for 1 minute. The toner dispersion thus prepared is added to "ISOTON II" (Beckman Coulter Inc.) in a beaker placed in sample stand by a pitette until the concentration displayed on the measuring equipment reaches 8%. Within this concentration range, reproducible measurement values can be obtained. The measuring particle count and the aperture size of the measuring equipment are set to 25000 and 100 μm respectively. The measuring range, which is from 2 μm to 60 μm, is divided into 256 sections to calculate the respective frequencies. The particle size where the accumulated volume counted from the largest size reaches 50% is determined as the volume median particle size.

Average Circularity of Toner

In the toner of the present invention, it is preferred that the toner particles of the toner have an average circularity of 0.930 to 1.000, more preferably 0.950 to 0.995 in terms of the stability of the charging characteristics and the low-temperature fixability.

When the average circularity is within the above-described range, the individual toner particles are less crushable. This prevents the triboelectric charge applying member from smudges and stabilizes the charging characteristics of the toners. Further, high quality images can be formed.

In the present invention, the average circularity of the toner particles is measured by an "FPIA-2100" (Sysmex Corp.).

Specifically, a sample (toner particles) is mixed with an aqueous solution containing a surfactant and is further dispersed by ultrasonication for 1 minute. Thereafter, photographs are taken by means of the "FPIA-2100" (Sysmex Corp.) in the conditions of the HPF (high power imaging) mode at an adequate concentration corresponding to an HPF detect number of 3000 to 10000. The average circularity of the toner is calculated by determining the circularity of each toner particle according to the following Equation (T) and dividing the sum of the circularities of the individual toners by the total number of toner particles.

Circularity=(Circumference of circle having same area as projected image of particle)/(Perimeter of projected image of particle) Equation (T):

Softening Point of Toner

It is preferred that the toner has a softening point of 80° C. to 120° C., more preferably 90° C. to 110° C. in terms of imparting the low-temperature fixability to the toner.

The softening point of the toner is measured by the following flow tester.

Specifically, 1.1 g of a sample (toner) is placed and flattened in a petri dish in the environment of 20° C. and 50% RH. After at least 12 hours, the sample was pressed at a pressure of 3820 kg/cm$^2$ for 30 seconds by means of a shaping machine "SSP-10A" (Shimadzu Corp.) to form a cylindrically shaped sample with a diameter of 1 cm. Then, after preheating is complete, the shaped sample is pushed out from a hole (1 mm in diameter×1 mm) of a cylindrer die by using a flow tester "CFT-500D" (Shimadzu Corp.) with a 1 cm-diameter piston in the conditions of a load of 196 N (20 kgf), an initial temperature of 60° C., a preheating time of 300 seconds, a heating rate of 6° C./minute in the environment of 24° C. and 50% RH. The offset temperature $T_{offset}$ at an offset value of 5 mm is measured by a melting temperature measuring method (elevated temperature method), and the measured value is determined as the softening point.

External Additive

The above-described toner particles can be directly used as the toner. However, in order to improve the fluidity, charging characteristics, cleaning property and the like, an external additive such as a so-called fluidizer and a cleaning aid may be added to the toner particles.

A variety of compounds may be used in combination as the external additive.

Such external additives are added in a total amount of preferably 0.05 parts by mass to 5 parts by mass, more preferably 0.1 parts by mass to 3 parts by mass with respect to 100 parts by mass of the toner particles.

In the above-described toner, the ratio the crystalline polyester resin being a crystal domain in the toner particles and the ratio of the crystalline polyester resin being a crystal domain in a fixed image after heat fixing are respectively within the specific ranges. Therefore, long-lasting crush resistance is achieved as well as adequate heat-resistant storage stability and adequate low-temperature fixability. Furthermore, a fixed image with good image storage stability can be formed.

Method for Producing Toner

It is preferred that the toner of the present invention is produced in an aqueous medium, i.e. by a wet method. For example, the toner can be produced by an emulsion aggregation method.

An emulsion aggregation method is a method for producing toner particles that involves mixing an aqueous dispersion of resin fine particles of a binder resin with an aqueous dispersion of fine particles of the other toner particle components according to need, allowing the fine particles to slowly aggregate and associate with each other while controlling the average particle size and the particle size distribution by keeping a balance between the repulsive force of the fine particle surface controlled by adjusting the pH and the cohesive force controlled by adding an electrolyte coagulant, and simultaneously with the association heating and stirring the dispersion to fuse of the fine particles to each other while controlling the shape.

A specific example of such methods for producing the toner involves the steps of:

(1) a coloring agent fine particle dispersion preparing step of dispersing the coloring agent in an aqueous medium to prepare a coloring agent fine particle dispersion;

(2) a crystalline polyester resin fine particle dispersion preparing step of dispersing the crystalline polyester resin in an aqueous medium to prepare a crystalline polyester resin fine particle dispersion;

(3) an amorphous resin fine particle dispersion preparing step of dispersing the amorphous resin containing, if necessary, other toner particle components such as a releasing agent and a charge controlling agent in an aqueous medium to prepare an amorphous resin fine particle dispersion;

(4) an aggregating and fusing step of aggregating and fusing the amorphous resin fine particles, the crystalline polyester resin fine particles and the coloring agent fine particles in an aqueous medium to form aggregated particles;

(5) an aging step of aging the aggregated particles by heat energy to adjust the shape, so as to prepare a toner particle dispersion;

(6) a cooling step of cooling the toner particle dispersion;

(7) a filtering and washing step of separating out the toner particles from the cooled toner particle dispersion and removing the surfactant and the like from the surface of the toner particles; and (8) a drying step of drying the washed toner particles.

If necessary, the method further involves the step of:

(9) an external additive adding step of adding an external additive to the dried toner particles.

As used herein, the term "aqueous medium" refers to a medium that is composed of 50 mass % to 100 mass % of water and 0 mass % to 50 mass % of a water-soluble organic solvent. Examples of such water-soluble organic solvents include methanol, ethanol, isopropanol, butanol, acetone, methylethylketone, tetrahydrofuran and the like. Alcohol organic solvents that do not dissolve the produced resin are preferably used.

(1) Coloring Agent Fine Particle Dispersion Preparing Step

The coloring agent fine particle dispersion can be prepared by dispersing the coloring agent in an aqueous medium. It is preferred that the aqueous medium to which the coloring agent is dispersed contains a surfactant at a concentration equal to or greater than the critical micelle concentration (CMC) since the coloring agent can be uniformly dispersed. A variety of dispersers known in the art may be used for dispersing the coloring agent.

Surfactant

Examples of surfactants that can be used include anionic surfactants such as alkyl sulfates, polyoxyethylene (n)alkylether sulfates, alkylbenzene sulfonates, α-olefin sulfonates, phosphates and the like; cationic surfactants including amine salt surfactants such as alkyl amine salts, aminoalcohol fatty acid derivatives, polyamine fatty acid derivatives and imidazoline, and quaternary annmonium surfactants such as alkyltrimethylannmonium salts, dialkyldimethylannmonium salts, alkyldimethylbenzylannmonium salts, pyridinium salts, alkylisoquinolinium salts and benzethonium chloride; nonionic surfactants such as fatty acid amide derivatives and polyhydric alcohol derivatives; ampholytic surfactants such as alanine, dodecyl(aminoethyl)glycine, di(octylaminoethyl)glycine and N-alkyl-N,N-dimethylannmonium betaine; and the like. In addition, anionic surfactants and cationic surfactants having a fluoroalkyl group may also be used.

It is preferred that the dispersed coloring agent fine particles have a volume median particle size of 10 nm to 300 nm in the coloring agent fine particle dispersion prepared in the coloring agent fine particle dispersion preparing step.

The volume median particle size of the coloring agent fine particles in the coloring agent fine particle dispersion is measured by an electrophoretic light scattering spectrometer "ELS-800" (Otsuka Electronics, Co. Ltd.).

Alternatively, the coloring agent may be introduced to the toner particles in the amorphous resin fine particle dispersion preparing step described below by dissolving or dispersing them in a monomer solution for producing the amorphous resin beforehand by a mini-emulsion method.

(2) Crystalline Polyester Resin Fine Particle Dispersion Preparing Step

Examples of methods for dispersing the crystalline polyester resin in an aqueous medium include an aqueous direct dispersion method of dispersing the crystalline polyester resin in an aqueous medium containing a surfactant by means of ultrasonic dispersion or bead mill dispersion, a dissolution-emulsification-desolvation method of dissolving the crystalline polyester resin in a solvent, dispersing the solution in an aqueous medium to form emulsion particles (oil particles) and then removing the solvent, a phase-inversion emulsification method, and the like.

It is preferred that the crystalline polyester resin fine particles obtained in the crystalline polyester fine particle dispersion preparing step have an average particle size within the range of, for example, 50 nm to 500 nm in volume median size.

The volume median particle size is measured by using a "UPA-150" (Microtrac Corp.).

(3) Amorphous Resin Fine Particle Dispersion Preparing Step

When the amorphous resin is an amorphous polyester resin, an amorphous resin fine particle dispersion can be prepared by dispersing the synthesized amorphous polyester resin in an aqueous medium. To disperse the amorphous polyester resin in an aqueous medium, the same method can be employed as the above-described method for dispersing the crystalline polyester resin in an aqueous medium.

When the amorphous resin is a styrene acrylate resin, the amorphous resin fine particle dispersion can be prepared by adding the resin to an aqueous medium containing a surfactant at a concentration equal to or greater than the critical micelle concentration (CMC), adding thereto a polymerizable monomer for producing the styrene acrylate resin, i.e. the amorphous resin, and adding an aqueous polymerization initiator at a desired polymerization temperature while stirring so as to polymerize the monomer.

Alternatively, when the amorphous resin is a styrene acrylate resin, the amorphous resin fine particle dispersion can be prepared by adding a monomer solution, in which a toner component such as the releasing agent and the charge controlling agent is dissolved or dispersed in a polymerizable monomer for producing the styrene acrylate resin, i.e. the amorphous resin, according to need, to an aqueous medium containing a surfactant at a concentration equal to or less than the critical micelle concentration (CMC), applying mechanical energy to form liquid particles, and then adding an aqueous radical polymerization initiator to cause a polymerization reaction in the liquid particles. The liquid particles may contain an oil-soluble polymerization initiator. In this amorphous resin fine particle dispersion preparing step, it is essential to apply mechanical energy to forcibly cause emulsification (formation of the liquid particles). To apply mechanical energy, means for applying intensive agitation or ultrasonic vibration energy such as a homomixer, an ultrasonic and a Manton-Gaulin homogenizer may be used.

The amorphous resin fine particle dispersion preparing step may be to form amorphous resin fine particles that are composed of two or more resin layers with different compositions. In this case, the step may involve preparing a dispersion of the first resin particles by an ordinary emulsion polymerization (first polymerization), and adding a polymerization initiator and a polymerizable monomer to the dispersion so as to polymerize the monomer in the system (second polymerization).

When a surfactant is used in this step, for example, the above-described surfactants may be used.

Polymerization Initiator

A variety of polymerization initiators known in the art can be used as the polymerization initiator. Specifically, such polymerization initiators include, for example, peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxydicarbonate, tetralin hydroperoxide, 1-phenyl-2-methylpropyl-1-hydroperoxide, tert-hydroxyperoxide triphenylperacetate, tert-butyl performate, tert-butyl peracetate, tert-butyl perbenzoate, tert-butyl phenylperacetate, tert-butyl methoxyperacetate and tert-butyl N-(3-toluyl)perpalmitate; azo compounds such as 2,2'-azobis(2-amidinopropane) hydrochloride, 2,2'-azobis-(2-amidinopropane) nitrate, 1,1'-azobis(sodium 1-methylbutyronitrile-3-sulfonate), 4,4'-azobis-4-cyanovaleric acid and poly(tetraethylene glycol-2,2'-azobisisobutyrate); and the like. Among them, aqueous polymerization initiators such as ammonium persulfate, sodium persulfate, potassium persulfate, hydrogen peroxide, 2,2'-azobis(2-amidinopropane) hydrochloride, 2,2'-azobis-(2-amidinopropane) nitrate, 1,1'-azobis(sodium 1-methylbutyronitrile-3-sulfonate) and 4,4'-azobis-4-cyanovaleric acid are preferably used. Also, redox polymerization initiators such as a combination of a persulfate with a metabisulfite and a combination of hydrogen peroxide with ascorbic acid may also be used as the polymerization initiator.

Chain Transfer Agent

In the amorphous resin fine particle dispersion preparing step, a generally-used chain transfer agent may be used for the purpose of adjusting the molecular weight of the amorphous resin. The chain transfer agent may be any agent, for example, including alkylmercaptan, mercapto fatty acid esters and the like.

It is preferred that the amorphous resin fine particles obtained in the amorphous resin fine particle dispersion preparing step have an average particle size within the range of, for example, 50 nm to 500 nm in volume median size.

The volume median particle size is measured by an "UPA-150" (Microtrac Corp.).

(4) Aggregating and Fusing Step

This step is to aggregate and fuse the coloring agent fine particles, the amorphous resin fine particles and the crystalline polyester resin fine particles formed in the above-described steps in an aqueous medium. This step involves adding the amorphous resin fine particle dispersion, the crystalline polyester resin fine particle dispersion and the coloring agent fine particle dispersion to an aqueous medium and aggregating and fusing their fine particles.

Specifically, an example method for aggregating and fusing the coloring agent fine particles, the amorphous resin fine particles and the crystalline polyester resin fine particles involves adding a coagulant to the aqueous medium to a concentration equal to or greater than the critical aggregation concentration, and then heating the dispersion at a temperature that is equal to or greater than both of the glass transition point of the amorphous resin fine particles and the melting peak temperature of the releasing agent and the crystalline polyester resin, so as to cause salting out and fusion of the fine particles including the coloring agent fine particles, the amorphous resin fine particles and the crystalline polyester resin fine particles at the same time, adding an aggregation terminator when the particles are grown to a desired particle size, so as to terminate the growth of the particles, and if necessary, further heating the dispersion continuously in order to control the particle shape.

In this method, it is preferred that after the coagulant is added, the dispersion is heated to a temperature equal to or greater than the glass transition point of the amorphous resin fine particles of the binder resin as soon as possible. The reason thereof is not clear, but problems may occur depending on the length of the time after the salting out and before the heating, such as change of the aggregated state of the particles that deteriorates the stability of the particle size distribution, and change of the surface properties of the fused particles. Typically, the time before the heating is preferably equal to or less than 30 minutes, more preferably equal to or less than 10 minutes. Further, the heating rate is preferably equal to or greater than 1° C./min. The upper limit of the heating rate is not particularly specified. However, the heating rate is preferably equal to or less than 15° C./min in terms of preventing coarse particles due to rapid fusion. Further, it is important that after the temperature of the reaction system reaches a temperature equal to or greater than the glass transition point, the temperature of the system is held at the same temperature for a certain period of time so as to allow the fusion to continue. This allows the growth and the fusion of the toner particles to proceed effectively, which can improve the durability of the resultant toner particles.

Coagulant

The coagulant used may be any coagulant but is preferably selected from metal salts. Such metal salts include, for example, monovalent metal salts such as salts of alkali metals such as sodium, potassium and lithium; divalent metal salts such as salts of calcium, magnesium, manganese and copper; trivalent metal salts such as salts of iron and aluminum; and the like. Specific examples of such metal salts include sodium chloride, potassium chloride, lithium chloride, calcium chloride, magnesium chloride, zinc chloride, copper sulfate, magnesium sulfate, manganese sulfate and the like. Among them, divalent metal salts are particularly preferred since the aggregation is caused by a smaller amount. These coagulants may be used alone or in combination.

When a surfactant is used in this step, for example, the above-described surfactants may be used.

(5) Aging Step

Specifically, this step is to heat and stir the system containing the aggregated particles to form the toner particles with a desired shape, in which the heating temperature, stirring speed and heating time are controlled so that the average circularity of the aggregated particles reaches a desired level. In this step, it is preferred that the shape of the toner particles is controlled by heat energy (heating).

(6) Cooling Step to (8) Drying Step

For the cooling step, the filtering and washing step and the drying step, a variety of methods known in the art may be employed.

(9) External Additive Adding Step

The external additive adding step is to add and mix an external additive to the dried toner particles according to need.

An example method for adding the external additive is a dry method in which a powder external additive is added and mixed to the dried toner particles. For the mixing, a mechanical mixing machine such as a Henschel mixer and a coffee mill may be used.

Developer

The toner of the present invention may be used as a magnetic or nonmagnetic monocomponent developer or may be mixed with a carrier and used as a two component developer.

For the carrier, magnetic particles known in the art may be used, for example, including metals such as ferrite and magnetite, alloys of these metals with another metal such as aluminum and lead, and the like. Among them, ferrite particles are preferably used. Also, coated carriers, in which the surface of magnetic particles is covered with a coating agent such as resin, and resin dispersed carriers, in which magnetic fine particles are dispersed in a binder resin, may also be used for the carrier.

It is preferred that the carrier has a volume average particle size of 15 μm to 100 μm, more preferably 25 μm to 80 μm.

Image Forming Apparatus

The toner of the present invention can be used in a typical electrophotographic image forming method. An example of image forming apparatuses by this image forming method includes a photoreceptor which is for example an electrostatic latent image carrier, a charging unit to apply uniform potential to the surface of the photoreceptor by corona discharge with the same polarity as the toner, an exposing unit to expose the uniformly charged surface of the photoreceptor based on an image data to form an electrostatic latent image, a developing unit to bring the toner to the surface of the photoreceptor to develop the electrostatic latent image to form a toner image, a transferring unit to transfer the toner image to a transfer material, if necessary, via an intermediate transfer body, and a fixing unit to heat and fix the toner image on the transfer material.

Further, the toner of the present invention can be suitably used for image forming apparatuses that operate at a relatively low fixing temperature (surface temperature of the fixing member) of 130° C. to 200° C.

Further, the toner of the present invention can be suitably used for image forming apparatuses that operate at a fixing speed (paper conveying speed) within the range of 50 mm/sec to 350 mm/sec.

While an embodiment of the present invention is specifically described, the embodiments of the present invention are not limited to the above-described examples, and various changes can be made.

EXAMPLES

Hereinafter, specific examples of the present invention will be described, but the present invention is not limited thereto.

Synthesis Example of Crystalline Polyester Resin (a)

Into a reaction vessel equipped with a stirrer, a nitrogen introducing tube, a temperature sensor and a rectifier, the polycarboxylic acid and
sebacic acid, 200 parts by mass
the polyhydric alcohol
ethylene glycol, 60 parts by mass were charged. The temperature of the reaction system was raised to 190° C. over 1 hour. After checking that the reaction system is uniformly stirred, $Ti(OBu)_4$ was added as a catalyst in an amount of 0.006 mass % with respect to the total amount of polycarboxylic acid. Then, the temperature of the reaction system was raised to 240° C. over 6 hours while distilling away produced water, and the temperature was held at 240° C. to allow the dehydration condensation reaction to further continue until the acid value reaches 20, so as to carry out polymerization to yield the crystalline polyester resin (a).

The resultant crystalline polyester resin (a) had a number average molecular weight (Mn) of 3100 and a melting point of 75° C. The acid value, molecular weight and melting point of the crystalline polyester resin (a) were measured as described above.

Preparation Example of Crystalline Polyester Resin Fine Particle Aqueous Dispersion (a)

The crystalline polyester resin (a) (300 parts by mass) was melted, and the melted resin was fed to an emulsion disperser "CAVITRON CD1010" (Eurotec Co., Ltd.) at a feeding rate of 15 parts by mass per minute while keeping the melted state. Simultaneously with feeding the melted crystalline polyester resin (a), 700 parts by mass of diluted ammonia water at a concentration of 0.37 mass %, which was prepared by diluting ammonia water regent with ion-exchanged water in an aqueous solvent tank, was fed to the emulsion disperser at a feeding rate of 35 parts by mass per minute while heating it at 100° C. by a heat exchanger. The emulsion disperser was operated in the conditions of a rotation speed of the rotator of 60 Hz and a pressure of 5 $kg/cm^2$. A crystalline polyester resin fine particle aqueous dispersion (a) having a volume median particle size of 200 nm and a solid fraction of 30 parts by mass was thus prepared.

Synthesis Examples of Crystalline Polyester Resins (b) to (e)

Crystalline polyester resins (b) to (e) were obtained in the same manner as the synthesis example of the crystalline polyester resin (a) except that the diols and the dicarboxylic acids listed in Table 1 were used respectively.

TABLE 1

| | RESIN COMPOSITION | | | | | |
|---|---|---|---|---|---|---|
| | POLYCARBOXYLIC ACID | | POLYHYDRIC ALCOHOL | | | |
| CRYSTALLINE POLYESTER RESIN NO. | SEBACIC ACID (PARTS BY MASS) | DODECANEDIOIC ACID (PARTS BY MASS) | ETHYLENE GLYCOL (PARTS BY MASS) | HEXANEDIOL (PARTS BY MASS) | NONANEDIOL (PARTS BY MASS) | DECANEDIOL (PARTS BY MASS) |
| a | 200 | 0 | 60 | 0 | 0 | 0 |
| b | 0 | 228 | 0 | 114 | 0 | 0 |
| c | 0 | 228 | 0 | | 155 | 0 |
| d | 200 | 0 | 0 | 114 | 0 | 0 |
| e | 0 | 228 | 0 | 0 | 0 | 169 |

Preparation Examples of Crystalline Polyester Resin Fine Particle Aqueous Dispersions (b) to (e)

Crystalline polyester resin fine particle aqueous dispersions (b) to (e) were prepared in the same manner as the preparation example of the crystalline polyester resin fine particle aqueous dispersion (a) except that the crystalline polyester resins (b) to (e) were respectively used instead of the crystalline polyester resin (a).

Synthesis Example of Amorphous Polyester Resin (a)

Into a reaction vessel equipped with a stirrer, a nitrogen introducing tube, a temperature sensor and a rectifier, the polycarboxylic acid and
fumaric acid, 2.8 parts by mass
terephthalic acid, 22.3 parts by mass
the polyhydric alcohol
an adduct of 2,2-bis(4-hydroxyphenyl)propane with 2 mol of propylene oxide, 52.4 parts by mass
an adduct of 2,2-bis(4-hydroxyphenyl)propane with 2 mol of ethylene oxide, 6.7 parts by mass were charged. The temperature of the reaction system was raised to 190° C. over 1 hour. After checking that the reaction system is uniformly stirred, $Ti(OBu)_4$ was added as a catalyst in an amount of 0.006 mass % with respect to the total amount of the polycarboxylic acid. Then, the temperature of the reaction system was further raised to 240° C. over 6 hours while distilling away produced water, and 2.4 parts by mass of trimellitic acid was added when the temperature reaches 240° C. The temperature was held at 240° C. to allow the dehydration condensation reaction to further continue until the acid value reaches 21, so as to carry out polymerization to yield the amorphous polyester resin (A).

The resultant amorphous polyester resin (A) had a number average molecular weight (Mn) of 3600, a glass transition point of 62° C.

Preparation of Amorphous Polyester Resin Fine Particle Aqueous Dispersion (A)

To a reaction vessel equipped with a stirring anchor blade, 240 parts by mass of methyl ethyl ketone, 60 parts by mass of isopropyl alcohol (IPA) were added, and nitrogen gas is fed to purge the air in the system. Then, while heating the system at 60° C. in an oil bath, 300 parts by mass of the amorphous polyester resin (A) was gradually added and dissolved therein while stirring. Then, after 20 parts by mass of 10% ammonia water was added, 1500 parts by mass of deionized water was charged by using a metering pump while stirring. The emulsified system colored in opaque white and the stirring viscosity decreased, by which occurrence of emulsification was confirmed.

Thereafter, the emulsion was collected by utilizing the pressure difference based on a centrifugal force, and the emulsion system was transferred to a separable flask equipped with a stirring blade for forming a wetted wall above the reaction site, a reflux and a decompression device with a vacuum pump. While the system was stirred under a decreased pressure at a wall temperature in the reaction site of 58° C., the solvent and the dispersion medium were distilled away. When the dispersion reaches 1000 parts by mass, the inner pressure of the reaction site was increased to ordinary pressure and the system was cooled to ordinary temperature to terminate the reaction, yielding an amorphous polyester resin fine particle aqueous dispersion (A) having a solid fraction of 30%.

The amorphous polyester resin fine particle aqueous dispersion (A) had a volume median particle size of the dispersed resin fine particles of 162 nm.

Synthesis Example of Amorphous Polyester Resins (B) to (F)

Amorphous polyester resins (B) to (F) were obtained in the same manner as the synthesis example of the amorphous polyester resin (A) except that the polyhydric alcohols and the polycarboxylic acids listed in Table 2 were used respectively.

TABLE 2

| | RESIN COMPOSITION | | | | |
|---|---|---|---|---|---|
| | POLYCARBOXYLIC ACID | | | POLYHYDRIC ALCOHOL | |
| AMORPHOUS POLYESTER RESIN No. | FUMARIC ACID (PARTS BY MASS) | TEREPHTHALIC ACID (PARTS BY MASS) | TRIMELLITIC ACID (PARTS BY MASS) | BPA-PO (PARTS BY MASS) | BPA-EO (PARTS BY MASS) |
| A | 2.8 | 22.3 | 2.4 | 52.4 | 6.7 |
| B | 2.8 | 22.3 | 2.4 | 47.4 | 11.3 |
| C | 2.8 | 22.3 | 2.4 | 42.4 | 15.9 |
| D | 4.1 | 20.4 | 2.4 | 47.4 | 11.3 |
| E | 4.1 | 20.4 | 2.4 | 42.4 | 15.9 |
| F | 2.8 | 20.4 | 4.8 | 47.4 | 11.3 |

Preparation Examples of Amorphous Polyester Resin Fine Particle Aqueous Dispersions (B) to (F)

Amorphous polyester resin fine particle aqueous dispersions (B) to (F) were prepared in the same manner as the preparation example of the amorphous polyester resin fine particle aqueous dispersion (A) except that the amorphous polyester resins (B) to (F) were used instead of the amorphous polyester resin (A).

Preparation Example of Coloring Agent Fine Particle Aqueous Dispersion (Bk)

Polyoxyethylene-2-sodium dodecylether sulfate (90 parts by mass) was added and dissolved to 1510 parts by mass of ion-exchanged water. While stirring the solution, 400 parts by mass of carbon black "REGAL 330" (Cabot Corp.) was gradually added thereto. Then, the mixture was subjected to a dispersing treatment using a disperser "CLEARMIX" (M Technique Co., Ltd.). A coloring agent fine particle aqueous dispersion (Bk) having a solid fraction of 20 mass % was thus prepared.

The resultant coloring agent fine particle aqueous dispersion (Bk) had an average particle size (volume median particle size) of the coloring agent fine particles of 110 nm, which was measured by using a "MICROTRAC UPA-150" (Nikkiso Co., Ltd.).

Preparation Example of Releasing Agent Fine Particle Aqueous Dispersion (W)

"FNP-0090" (Nippon Seiro Co., Ltd.) (50 parts by mass), 5 parts by mass of polyoxyethylene-2-sodium dodecylether sulfate and 195 parts by mass of ion-exchanged water were heated at 90° C. and dispersed well by using a homogenizer "ULTRA-TURRAX T50" (IKA-Werke GmbH & Co. Kg). Thereafter, the solution was further dispersed by using a pressure Gorlin homogenizer. A releasing agent fine particle aqueous dispersion (W) was thus prepared.

The resultant releasing agent fine particle aqueous dispersion (W) had a volume median particle size of the releasing agent fine particles of 170 nm.

Example 1

Toner Production Example 1

Into a reaction vessel equipped with a stirrer, a temperature sensor, a cooling tube and a nitrogen introducing device, 765 parts by mass of the amorphous polyester resin fine particle aqueous dispersion (A), 75 parts by mass of the coloring agent fine particle aqueous dispersion (Bk), 150 parts by mass of the releasing agent fine particle aqueous dispersion (W) and 625 parts by mass of ion-exchanged water were charged. Then, the pH was adjusted to 11 (20° C.) by adding 5 mol/L sodium hydroxide aqueous solution while stirring.

Then, an aqueous solution of 50 parts by mass of magnesium chloride dissolved in 50 parts by mass of ion-exchanged water was added at a rate of 4 parts by mass per minute. Five minutes after the addition, 85 parts by mass of the crystalline polyester resin fine particle aqueous dispersion (a) was added at a rate of 3 parts by mass per minute. Five minutes after the addition, the temperature of the system was raised to 70° C. over 60 minutes to initiate aggregation. After initiating the aggregation, the product was periodically sampled, and the volume median particle size of the aggregated particles was measured by using a "Coulter Multisizer 3" (Beckman Coulter, Inc.). While stirring, the aggregation was allowed to continue until the volume median particle size reaches 6.3 μm. If necessary, the stirring speed was decreased.

When the volume median particle size reached 6.3 μm, the stirring speed was increased, and an aqueous solution of 100 parts by mass of sodium chloride dissolved in 400 parts by mass of ion-exchanged water was added. The temperature of the system was raised to 80° C. and the stirring was continued. When the circularity measured by a dynamic flow particle imaging instrument "FPIA-2100" (Sysmex Corp.) reached 0.946, the reaction system was cooled to 30° C. at a rate of 6° C./min to terminate the reaction, yielding a coloring particle dispersion. The cooled coloring particles had a particle size of 6.1 μm and a circularity of 0.946.

The resultant coloring particle dispersion was subjected to solid-liquid separation by using a basket centrifuge "MARK III, type 60×40" (Matsumoto Kikai Co., Ltd.) to form a wet cake. The wet cake was further subjected to washing and solid-liquid separation repeatedly by using the basket centrifuge until the electrical conductivity of the filtrate reaches 15 μS/cm. The washed cake was gradually fed to a "Flash Jet Dryer" (Seishin Enterprise Co., Ltd.) to be exposed to air blow at a temperature of 40° C. and a humidity of 20% RH. The washed cake was thus dried to a water content of approximately 2.0 mass %, and then was cooled to 24° C. Thereafter, the dried cake was transferred to a "vibrating fluidized bed machine" (Chuo Kakohki Co., Ltd.) and was dried at a toner temperature of 40° C. for 2 hours to yield toner particles (1×) having a water content of 0.5% or less.

To the resultant toner particles (1×), 1 mass % of hydrophobic silica and 1.2 mass % of hydrophobic titanium oxide were added, and the mixture was mixed for 20 minutes by using a "Henschel mixer" (Mitsui Miike Machinery Co., Ltd.) in the condition of a rotary blade circumferential speed of 24 mm/sec. Thereafter, coarse particles were removed by using a #400 sieve, and the external additive was added. A toner (1) was thus produced.

For the toner (1), the differential scanning calorimetry was conducted as described above by using a "Diamond DSC" (PerkinElmer Inc.) to calculate ΔH1 and ΔH2. The results are shown in Table 3.

Example 2 to Example 7, Comparison 1 and Comparison 4: Toner Production Examples 2 to 7, 11 and 14

Toners (2) to (7), (11) and (14) were obtained in the same manner as the toner production example 1 except that the materials listed in Table 3 were used respectively instead of the amorphous polyester resin fine particle aqueous dispersion (A) and the crystalline polyester resin fine particle aqueous dispersion (a).

Example 8 to Example 10

Toner Production Examples 8 to 10

Toners (8) to (10) were obtained in the same manner as the toner production example 2 except that the amount of the crystalline polyester resin fine particle aqueous dispersion (a) introduced with respect to the crystalline polyester resin fine particle aqueous dispersion (a) and the amorphous polyester resin fine particle aqueous dispersion (A) was changed respectively to 5 mass %, 20 mass % and 30 mass %.

Comparison 2

Toner Production Example 12

A toner (12) was obtained in the same manner as the toner production example 1 except that the cooling rate after the average circularity reached 0.946 was changed to a value within the range of 15° C./min to 25° C./min, and the washed cake was dried in a low-temperature low-humidity environment of a temperature of 10° C. and a humidity of 10% RH after it was broken by hand and sieved through a mesh with 2-mm opening.

Comparison 3

Toner Production Example 13

A toner (13) was obtained in the same manner as the toner production example 5 except that the amount of the crystalline polyester resin fine particle aqueous dispersion (c) introduced with respect to the crystalline polyester resin fine particle aqueous dispersion (c) and the amorphous polyester resin fine particle aqueous dispersion (D) was changed to 30 mass %.

TABLE 3

| | | | CRYSTALLINE POLYESTER RESIN | | | | | PHYSICAL PROPERTIES OF TONER | | | | |
|---|---|---|---|---|---|---|---|---|---|---|---|---|
| | TONER No. | AMORPHOUS RESIN FINE PARTICLE AQUEOUS DISPERSION NO. | CRYSTALLINE RESIN FINE PARTICLE AQUEOUS DISPERSION NO. | $C_{add}$ | $C_{alcohol}$ | INTRODUCED AMOUNT (MASS %) | MELTING POINT (° C.) | ΔH (theo.) | ΔH1 (J/g) | ΔH2 | ΔH1/ΔH (theo.) | ΔH2/ΔH (theo.) |
| EXAMPLE 1 | 1 | A | a | 10 | 2 | 10 | 75 | 15.41 | 4.72 | 2.01 | 0.306 | 0.130 |
| EXAMPLE 2 | 2 | B | a | 10 | 2 | 10 | 75 | 15.41 | 5.56 | 2.49 | 0.361 | 0.162 |
| EXAMPLE 3 | 3 | B | b | 12 | 6 | 10 | 69 | 18.93 | 8.31 | 3.63 | 0.439 | 0.192 |
| EXAMPLE 4 | 4 | C | e | 12 | 10 | 10 | 82 | 20.38 | 8.92 | 5.82 | 0.438 | 0.286 |
| EXAMPLE 5 | 5 | D | c | 12 | 9 | 10 | 68 | 20.06 | 6.40 | 2.21 | 0.319 | 0.110 |
| EXAMPLE 6 | 6 | E | c | 12 | 9 | 10 | 68 | 20.06 | 7.86 | 3.94 | 0.392 | 0.196 |
| EXAMPLE 7 | 7 | F | d | 10 | 6 | 10 | 61 | 17.97 | 3.82 | 1.91 | 0.213 | 0.106 |
| EXAMPLE 8 | 8 | B | a | 10 | 2 | 5 | 75 | 7.71 | 1.64 | 0.90 | 0.213 | 0.117 |
| EXAMPLE 9 | 9 | B | a | 10 | 2 | 20 | 75 | 30.83 | 11.40 | 5.20 | 0.370 | 0.169 |
| EXAMPLE 10 | 10 | B | a | 10 | 2 | 30 | 75 | 46.24 | 21.30 | 8.32 | 0.461 | 0.180 |
| COMPARISON 1 | 11 | C | a | 10 | 2 | 10 | 75 | 15.41 | 1.00 | 0.60 | 0.065 | 0.039 |
| COMPARISON 2 | 12 | A | a | 10 | 2 | 10 | 75 | 15.41 | 2.95 | 1.98 | 0.191 | 0.128 |
| COMPARISON 3 | 13 | D | c | 12 | 9 | 30 | 68 | 60.18 | 30.9 | 16.9 | 0.513 | 0.281 |
| COMPARISON 4 | 14 | A | e | 12 | 10 | 10 | 82 | 20.38 | 9.76 | 6.62 | 0.479 | 0.325 |

Carrier Production Example

Manganese-magnesium ferrite particles with a weight average particle size of 50 μm were coated by a coating agent that contains 85 parts by mass (in solid fraction) of a silicone resin (cured by oxime, in toluene solution), 10 parts by mass of γ-aminopropyltrimethoxysilane (coupling agent), 3 parts by mass of alumina particles (particle size of 100 nm) and 2 parts by mass of carbon black by means of spray coating. The particles were baked at 190° C. for 6 hours and were thereafter allowed to cool to ordinary temperature to yield a resin-coated carrier. The average film thickness of the resin coating was 0.2 μm.

Developer Production Examples 1 to 14

The carrier thus produced (94 parts by mass) was mixed with 6 parts by mass of the above-described toners (1) to (14) by using a V mixer to produce respective developers (1) to (14). The mixing was terminated when the charge amount of the toner reached from 20 to 23 μC/g, and the produced developer was discharged to a polyethylene pot.

(1) Crush Resistance

By using the developers (1) to (14), a text image with a coverage ratio of 10% were printed continuously on 100000 sheets under an L/L environment (temperature of 10° C., humidity of 15% RH) or an H/H environment (temperature of 30° C., humidity of 85% RH), and then a halftone image was printed on a single sheet. The halftone image was observed visually or under a 20× magnifying glass to evaluate the fog in a white background area and the image shaggy in an image area according to the following evaluation criterion. The results are shown in Table 4.

Evaluation Criterion

◎: Neither image shaggy nor fog was observed (acceptable).

○: Slight image shaggy and/or slight fog was observed under a 20× magnifying glass but is acceptable in practical use (acceptable).

x: Image shaggy and fog were observed and were not acceptable in practical use (unacceptable).

(2) Heat-Resistant Storage Stability of Toner

For each of the toners (1) to (14), 0.5 g of the toner was weighed in a 10 mL glass bottle having an inner diameter of 21 mm, and the lid was closed. The bottle was shaken for 600 times at room temperature by using a shaker "Tap Denser KYT-2000" (Seishin Enterprise Co., Ltd.). The bottle was left for 2 hours with the lid off in an environment of a temperature of 55° C. and a humidity of 35% RH. Then, the toner was placed on a #48 sieve (opening size of 350 μm) with care so that toner aggregates are not crushed. The sieve was set to a "Powder Tester" (Hosokawa Micron Corp.) and fixed with a pressure bar and a knob nut. The vibration strength was adjusted to a width of 1 mm, and a vibration was applied for 10 seconds. Thereafter, the ratio (mass %) of the toner left on the sieve was measured, and the toner aggregation rate was calculated according to the following Equation (A). The heat-resistant storage stability of the toner particles was evaluated according to the measured toner aggregation rate. The results are shown in Table 4. A toner having a toner aggregation rate of 20% or less is determined as acceptable.

$$\text{Toner aggregation rate (\%)} = (\text{Mass (g) of toner left on sieve})/0.5\ (\text{g}) \times 100 \qquad \text{Equation (A):}$$

(3) Low-Temperature Fixability

The low-temperature fixability was evaluated by the lowest fixing temperature that is the higher temperature between the lowest fixing temperatures evaluated respectively by the following (3-1) fixability against rubbing and (3-2) low-temperature offset evaluation. The results are shown in Table 4. When the lowest fixing temperature is equal to or less than 155° C., the toner was determined as acceptable.

(3-1) Fixability Against Rubbing

The developers (1) to (14) were subjected to a fixing test in which a solid image having a toner amount of 5 mg/cm$^2$ was fixed on a high-quality A4 paper with a basis weight of 80 g under an ordinary-temperature ordinary-humidity environment (temperature of 20° C., humidity of 50% RH) by using a modified "BIZHUB PRO C6500" (Konica Minolta, Inc.). The fixing test was repeated at elevated fixing temperatures from 80° C., 85° C. . . . to 180° C. at 5° C. intervals.

For the printed sheets obtained in the fixing test at different fixing temperatures, a patch portion having a relative image density to a white paper measured by a Macbeth reflection densitometer "RD-918" of 1.00±0.05 is selected as a measuring portion. The measuring portion was rubbed with a plain-woven bleached cotton cloth at a load of 22 g/cm$^2$ for 14 times, and then the image density of the measuring portion was measured. The density ratio before and after the rubbing was calculated as the fixing rate according to the following Equation (B). The lowest temperature at which the fixing rate is equal to or greater than 90% was determined as the lowest fixing temperature.

$$\text{Fixing rate (\%)} = \{(\text{Image density after rubbing})/(\text{Image density before rubbing})\} \times 100 \qquad \text{Equation (B):}$$

(3-2) Low-Temperature Offset Evaluation

The developers (1) to (14) were subjected to a fixing test in which an A4 image with a 5-mm wide solid black band perpendicular to the conveying direction was fixed on a high-quality A4 paper with a basis weight of 80 g in a short edge feeding mode, and then another A4 image with a 5-mm wide solid black band and 20-mm wide halftone image perpendicular to the conveying direction was fixed on the same paper in a long edge feeding mode under an ordinary-temperature ordinary-humidity environment (temperature of 20° C., humidity of 50% RH) by using a modified "BIZHUB PRO C6500" (Konica Minolta, Inc.). The fixing test was repeated at elevated fixing temperatures from 80° C., 85° C. . . . to 180° C. at 5° C. intervals. The temperatures at which an image smear due to fixing offset occurred were determined. The lowest temperature at which no image smear due to fixing offset was visually observed was determined as the lowest fixing temperature.

(4) Image Storage Stability (Resistance to Document Offset)

With the developers (1) to (14), duplex printing was carried out continuously on 50 sheets at a linear paper conveying speed of 250 mm/sec by using a modified "BIZHUB PRO C6500" (Konica Minolta, Inc.). The duplex printing was carried out such that a solid image with a toner amount of 5 mg/cm$^2$ was fixed on one side of a transfer paper, and an image composed of a text image of 36 lines of 6.0-point alphabets in the upper half and a solid image with a toner amount of 5 mg/cm$^2$ in the lower half was fixed on the other side.

Then, the 50 sheets of output printed matter were directly stacked on a marble table, and a weight is placed thereon so that a pressure of 19.6 kPa (200 g/cm$^2$) was applied to the stacked portion. After the pressure was applied under an environment of a temperature of 30° C. and a humidity of 60% RH for 3 days, the stacked fixed images are separated from each other, and the degree of image loss in the stacked fixed images was evaluated according to the following image criteria.

The results are shown in Table 4. In the present invention, "excellent (◎)", "very good (○)" and "good (Δ)" are determined as acceptable.

Evaluation Criteria

Excellent (◎): Neither image defect due to transferred toner nor even slight adhesion between fixed images are found. The degree of image loss is absolutely at an acceptable level.

Very good (○): There is a cracking sound when separating stacked two printed sheets, but no image defect is found. The degree of image loss is at an acceptable level.

Good (Δ): Slight unevenness in gloss appears in fixed images when separating stacked two printed sheets, but no image defect is found. The degree of image loss is little.

Poor (x): Image migration was found in the background area of the text image, or the text image is transferred to the background that was in contact with the text image. Image loss in the text image or bumps in the background are found.

TABLE 4

| | | EVALUATION RESULT | | | |
|---|---|---|---|---|---|
| | TONER No. | CRUSH RESISTANCE | HEAT-RESISTANT STORAGE STABILITY (MASS %) | LOW-TEMPERATURE FIXABILITY (° C.) | IMAGE STORAGE STABILITY |
| EXAMPLE 1 | 1 | ◎ | 17 | 138 | ○ |
| EXAMPLE 2 | 2 | ◎ | 9 | 142 | ◎ |
| EXAMPLE 3 | 3 | ○ | 8 | 148 | ◎ |
| EXAMPLE 4 | 4 | ○ | 5 | 154 | ◎ |
| EXAMPLE 5 | 5 | ◎ | 18 | 139 | ○ |
| EXAMPLE 6 | 6 | ◎ | 13 | 144 | ◎ |
| EXAMPLE 7 | 7 | ◎ | 19 | 137 | ○ |
| EXAMPLE 8 | 8 | ◎ | 16 | 145 | ○ |
| EXAMPLE 9 | 9 | ◎ | 14 | 139 | ◎ |
| EXAMPLE 10 | 10 | ○ | 17 | 143 | ◎ |
| COMPARISON 1 | 11 | ◎ | 63 | 130 | X |
| COMPARISON 2 | 12 | ◎ | 36 | 136 | ○ |
| COMPARISON 3 | 13 | X | 16 | 156 | ◎ |
| COMPARISON 4 | 14 | ○ | 3 | 163 | ◎ |

This U.S. patent application claims priority to Japanese patent application No. 2014-213489 filed on Oct. 20, 2014, the entire contents of which are incorporated by reference herein for correction of incorrect translation.

What is claimed is:

1. An electrostatic image developing toner comprising toner particles that contain a binder resin and a coloring agent, wherein the binder resin comprises an amorphous resin and a crystalline polyester resin, and wherein the electrostatic image developing toner satisfies both of the following Relation (1) and Relation (2), $$0.2 \leq \Delta H1/\Delta H(\text{theo.}) \leq 0.5 \quad \text{Relation (1):}$$

$$0.1 \leq \Delta H2/\Delta H(\text{theo.}) \leq 0.3 \quad \text{Relation (2):}$$

where ΔH1 (J/g) is the amount of heat absorption based on a melting peak of the crystalline polyester resin in a first heating step from room temperature to 150° C., determined on a DSC curve of the electrostatic image developing toner measured by a differential scanning calorimetry, ΔH2 (J/g) is the amount of heat absorption based on a melting peak of the crystalline polyester resin in a second heating step from 0° C. to 150° C., determined on the DSC curve of the toner, and ΔH(theo.) is a value of fusion enthalpy calculated from a mass ratio of a structural unit derived from a linear aliphatic monomer contained in the binder resin based on a group contribution method.

2. The electrostatic image developing toner according to claim 1, wherein the crystalline polyester resin has a melting point of 65° C. to 85° C.

3. The electrostatic image developing toner according to claim 1, wherein in Relation (2), the electrostatic image developing toner satisfies 0.12≤ΔH2/ΔH(theo.)≤0.28.

4. The electrostatic image developing toner according to claim 1, wherein in Relation (2), the electrostatic image developing toner satisfies 0.15≤ΔH2/ΔH(theo.)≤0.28.

5. The electrostatic image developing toner according to claim 1, wherein in Relation (2), the electrostatic image developing toner satisfies 0.16≤ΔH2/ΔH(theo.)≤0.20.

6. The electrostatic image developing toner according to claim 1, wherein ΔH2 is from 2 J/g to 10 J/g.

7. The electrostatic image developing toner according to claim 1, wherein in Relation (1), the electrostatic image developing toner satisfies 0.3≤ΔH1/ΔH(theo.)≤0.5.

8. The electrostatic image developing toner according to claim 1, wherein in Relation (1), the electrostatic image developing toner satisfies 0.32≤ΔH1/ΔH(theo.)≤0.45.

9. The electrostatic image developing toner according to claim 1, wherein in Relation (1), the electrostatic image developing toner satisfies 0.35≤ΔH1/ΔH(theo.)≤0.43.

10. The electrostatic image developing toner according to claim 1, wherein ΔH1 is from 3 J/g to 30 J/g.

11. The electrostatic image developing toner according to claim 1, wherein a content of the crystalline polyester resin in the binder resin is from 5 mass % to 50 mass %.

12. The electrostatic image developing toner according to claim 1, wherein a content of the crystalline polyester resin is from 10 mass % to 20 mass %.

13. The electrostatic image developing toner according to claim 1, wherein the electrostatic image developing toner satisfies the following Relation (3).

$$\Delta H2 < \leq \Delta H1 \quad \text{Relation (3):}$$

* * * * *